United States Patent [19]

Heinze et al.

[11] 4,404,696

[45] Sep. 20, 1983

[54] FLUID VELOCITY ASSIST

[75] Inventors: Walter O. Heinze, Green Valley, Ariz.; Wesley M. Tufts, Holliston; Jeffrey F. White, Avon, both of Mass.

[73] Assignee: International Water Saving Systems, Inc., New York, N.Y.

[21] Appl. No.: 291,224

[22] Filed: Aug. 10, 1981

[51] Int. Cl.[3] ..... E03D 9/06; E03D 11/06

[52] U.S. Cl. ..... 4/420

[58] Field of Search ..... 4/420, 661; 239/598

[56] References Cited

U.S. PATENT DOCUMENTS

| | | | |
|---|---|---|---|
| 272,539 | 2/1883 | Foley | 4/420 |
| 1,142,249 | 6/1915 | Griffiths | 4/420 |
| 1,335,267 | 3/1920 | Ambrose et al. | 239/598 X |
| 1,683,884 | 9/1928 | Griffiths | 4/420 |
| 1,766,126 | 6/1930 | Johnson | 239/598 |
| 3,979,781 | 9/1976 | Jolicoeur | 4/420 X |
| 4,106,131 | 8/1978 | Delker | 4/420 X |
| 4,183,105 | 1/1980 | Womack | 4/420 X |

*Primary Examiner*—Charles E. Phillips
*Attorney, Agent, or Firm*—Robert T. Gammons

[57] ABSTRACT

A toilet bowl provided with one or more fountains supported inside the rim so structured as to project solid, fan-shaped sheets of flush water downwardly on the inner surface of the bowl and a flange peripherally of the rim overlying the fountains.

2 Claims, 5 Drawing Figures

FLUID VELOCITY ASSIST

BACKGROUND OF INVENTION

Conventionally, the rim of a toilet bowl is provided with a cored-out, circumferentially-arranged passage and ports are provided at the inner side of the rim in communication with the passage through which water flows and is admitted to the bowl when the toilet is flushed. The water enters the bowl through the ports at relatively low pressure and, hence, merely flows downwardly on the surface without force enough to wash away stubbornly adhering matter. Furthermore, applying water in this fashion requires a large volume of water. Spray heads have been tried in lieu of ports, but have been found wanting because the fine streams of water from the spray heads strike the surface at spaced intervals and, hence, do not wash down the entire surface and because they generate a mist or vapor which is unpleasant. It is the purpose of this invention to provide for scouring the surface at each flushing by propelling solid sheets of flush water downwardly on substantially the entire surface with such force as to remove, without having to employ a large volume of flush water, the most stubbornly adhering matter.

SUMMARY OF INVENTION

As herein illustrated, the toilet bowl has top and bottom openings, the top opening being structured to support a seat and the bottom opening being structured to be connected by means of a trap to a waste pipe to enable discharging effluent from the bowl. In accordance with the invention, there are one or more fountains at the rim of the bowl for receiving water under pressure and propelling it forcibly downwardly on the internal surface of the bowl in the form of one or more solid, fan-shaped sheets. The fountains comprise downwardly-open slots defined by narrowly-spaced, parallel surfaces substantially parallel to the surface of the bowl where located, one of which contains a port in communication with the source of water pressure. In the preferred form, the bowl is provided at its rim with a cored passage adapted to be connected to a source of water and with openings into the interior of the bowl and the fountains are structured to be fitted into the openings. Specifically, each fountain contains a slot open at its opposite ends defined by spaced, parallel walls and a port in one of the walls perpendicular to the opposite wall, symmetrical with respect to the ends of the slot and tangent to the bottom of the slot. When positioned in an opening in the rim, the slot is downwardly open so that the bottom of the slot is horizontal and faces downwardly toward the bottom of the bowl. Desirably, the slot is longitudinally wider than it is deep. Preferably, two such fountains are employed, one at each side of the bowl, to wash the two opposite sides and the ends. Optionally, additional fountains may be employed. A downwardly-projecting flange is provided at the rim of the bowl which overlies the fountains. The flange is continuous peripherally of the bowl and, in conjunction with the rim of the bowl, defines a downwardly-open groove. The flange is recessed to receive the fountains.

The invention will now be described in greater detail with reference to the accompanying drawings, wherein.

Figure 1:
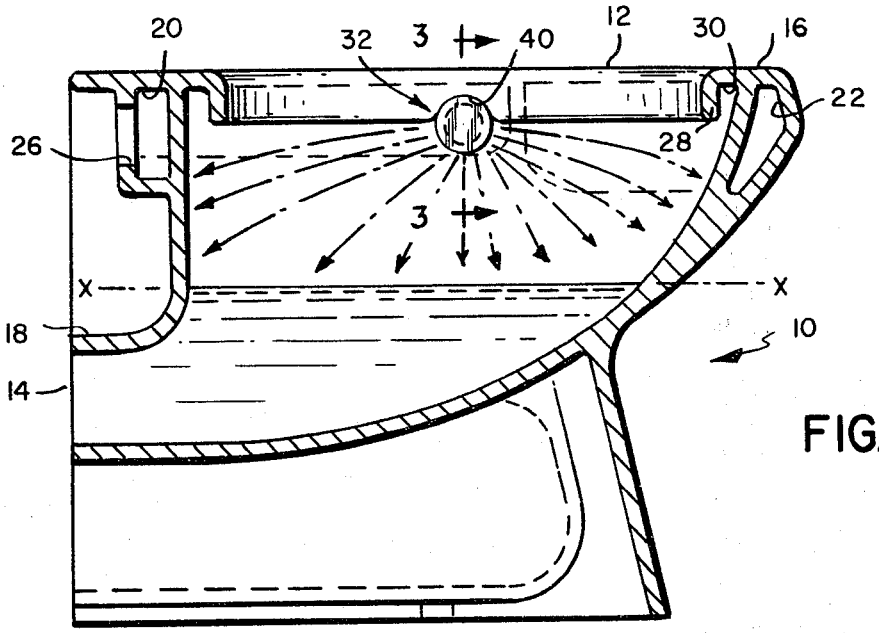
FIG. 1 is a front-to-back vertical section through a toilet bowl embodying the invention.
Figure 2:
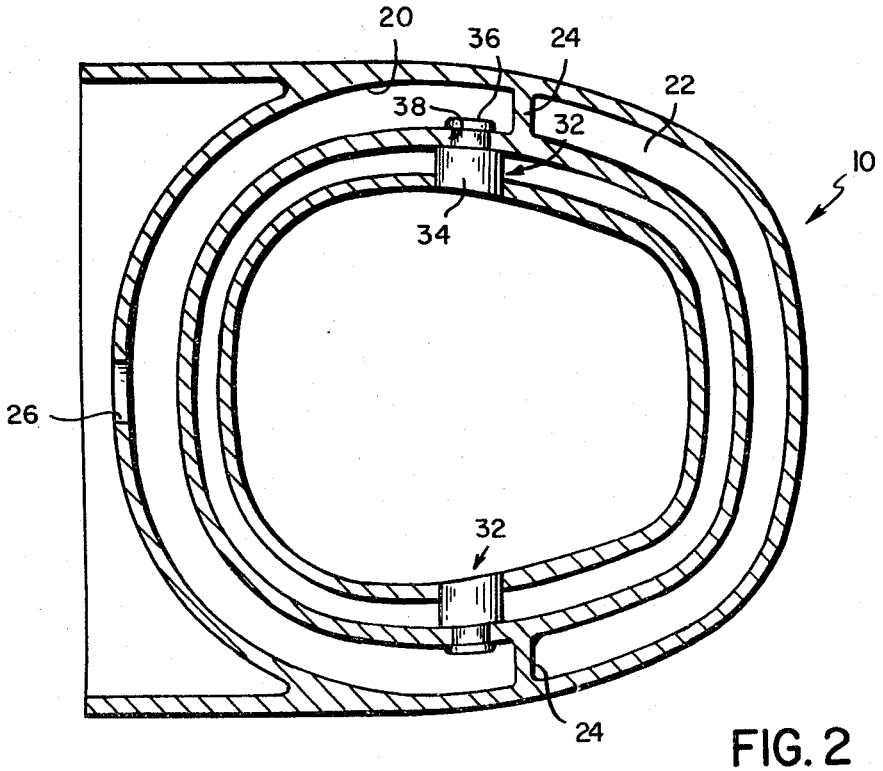
FIG. 2 is a horizontal section of the bowl shown in FIG. 1.

Referring to the drawings, there is shown a toilet bowl 10 of more or less conventional construction having an opening 12 at the top and an opening 14 at the bottom. Peripherally of the top opening, there is a flat, annular, planar surface 16 structured to support a seat. Peripherally of the bottom opening, there is a circular flange 18 structured to receive a discharge conductor. At the rim of the bowl, there are cored passages 20 and 22 divided from each other by a transverse wall 24. The rearwardly-located cored passage 20 is provided with an opening 26 structured to be connected to a source of water under pressure. At the inner side of the rim, there is an inwardly-spaced, downwardly-projecting flange 28 which defines with the inner side of the rim a downwardly-open groove 30. When installed, the flange 18 is connected by way of a water trap not shown to a soil pipe so that water stands in the bowl at the level X—X.

In accordance with this invention, means is provided for forcibly projecting solid, fan-shaped sheets of flush water downwardly on the inner surface of the bowl so that it scrubs and washes the entire interior surface. The preferred structure comprises fountains 32—32, FIG. 4, arranged at opposite sides of the bowl opposite each other and substantially midway between the front and back ends of the bowl. Each fountain, FIG. 5, comprises a head 34 and a stem 36, the latter at least being comprised of a yieldable material so that it can be forced into and frictionally engaged within an opening 38 at the inner side of the bowl which is in communication with the cored passage 20. The flange 28 is desirably provided with a downwardly-open recess 40 for receiving the head 34 of the part 32 and is spaced from the inside surface of the bowl so that the face of the head is flush with the inside surface of the flange.

Figure 3:
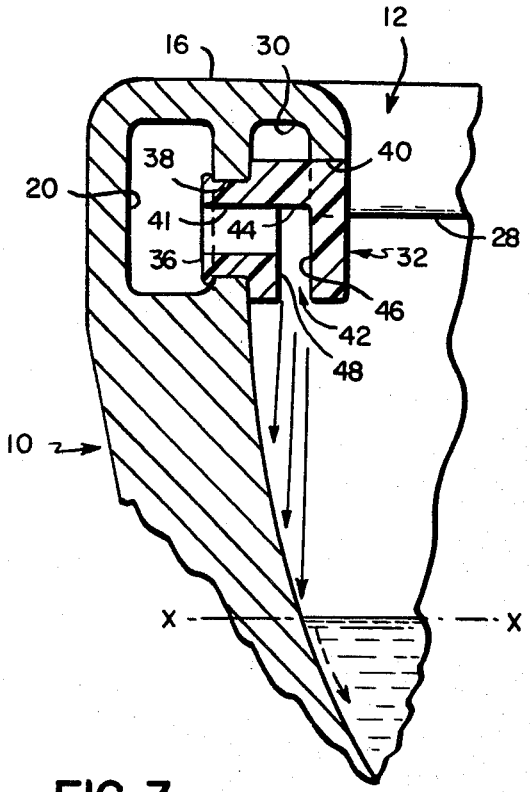
FIG. 3 is a fragmentary vertical section taken on the line 3—3 of FIG. 1.
Figure 5:
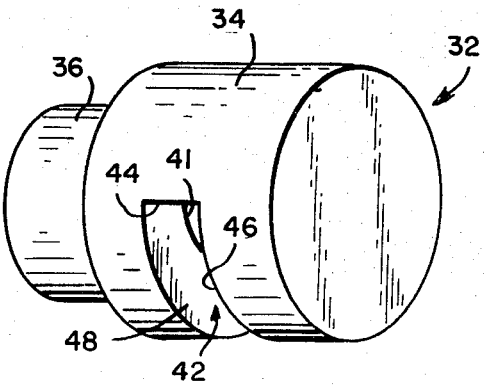
FIG. 5 is a perspective of a fountain filling.

Each fountain 32, as shown in FIGS. 3 and 5, comprises a head 34 and stem 36 of cylindrical cross section, concentric with each other and contain, respectively, in the stem 36 a cylindrical port 41 which extends through the stem 36 into the head 34 and a downwardly-open slot 42 at the inner end of the port 41 which has a horizontal closed bottom side 44 substantially tangent to the top of the port 41 and vertically-spaced, parallel sides 46 and 48, the side 48 containing the port 41 and the side 46 being imperforate. The part 32 may be comprised entirely of a material sufficiently yieldable so that the stem 36 can be force-fitted into the opening 38 and frictionally retained therein. Optionally, the head could be made of a rigid, non-yieldable material and the stem of a yieldable material. As shown in FIG. 3, the flange 28 overlies the fountain 32.

Figure 4:
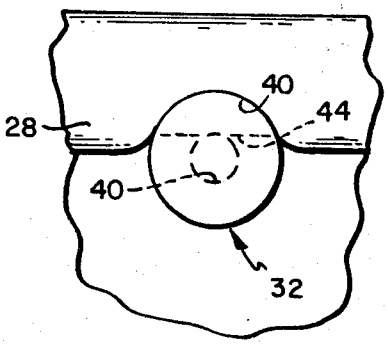
FIG. 4 is a fragmentary elevation as seen from the right side of FIG. 3.

As thus constructed, when water under pressure is supplied to the passage 20 upon flushing of the toilet, it is delivered by way of the fountains 32 downwardly in the form of solid, fan-shaped sheets of water onto the surface of the bowl with sufficient force so as to scrub and wipe away the most stubborn stains without having to employ a large quantity of water. In actuality, the water impinges upon the surface, striking the surface at a pressure of approximately twenty pounds per square inch. The sheet of water which is developed by the slot as can be seen in FIGS. 1 and 4 originates at the bottom of the slot which is tangent to the top of the port 41 so that it is deflected thereby in a downwardly, fan-shaped configuration as also shown in FIG. 1 to thus cover the entire interior surface of the bowl above the level of the water at each side from front to back. This, of course, is quite different from the conventional porting of the rim of a bowl through which the flush water in conventional toilets flows rather feebly downwardly onto the interior surface of the bowl without any impact. Propelling the water downwardly in a solid sheet, in addition to scrubbing the surface, avoids the formation of vapor or mist which is most unpleasant.

Ink stains applied to the walls of a bowl above the water line by means of a ball point pen which require 2 to 4 flushings with conventional toilets are completely removed by a single flushing with toilet bowls equipped with the fountains described above.

While the fountains 32 have been shown mounted at opposite sides of the bowl midway between the front and back ends thereof, it is within the scope of the invention to use more than the two illustrated along the sides and, additionally, if desired, to use them at the ends. However, for most purposes, the two, as shown, where a water pressure of 20 pounds per square inch is available, entirely suffice for maintaining the most frequently used toilets.

The interior surface of the bowl most plagued with adherent feces is that above the water level. Hence, it is important to position the fountains so that the downwardly-directed sheets of water are concentrated on the surface of the bowl located above the surface of the water to obtain the maximum scrubbing action. Further, it is important to confine the downwardly-directed sheets of water to this area so that they will not impinge upon the water at the water level and thus cause splashing.

It is to be understood that the configuration of the bowl herein illustrated and disclosed is merely illustrative, that it may be constructed of porcelain, plastic or metal and that, desirably, the fountains 32 are comprised of a suitable plastic so as to be readily moldable to the desired configuration. While it is shown of circular cross section, it is within the scope of the invention to make it of rectangular or polygonal cross section. Desirably, the port 41 is approximately 3/16 of an inch in diameter, the width of the slot is 1/16 of an inch from front to back and the depth is ½ inch.

It should be understood that the present disclosure is for the purpose of illustration only and includes all modifications or improvements which fall within the scope of the appended claims.

We claim:

1. In combination; a toilet bowl having a concave interior surface terminating in a bottom opening structured to be connected by a trap to a soil pipe so that water stands at a predetermined level in the bowl above the bottom opening, a rim at the top of the bowl defining a closed passage peripherally thereof, said closed passage being provided with an opening at the rear of the bowl for connection to a source of water under pressure, means defining a skirt inwardly of the rim forming a downwardly-open, continuous slot peripherally of the rim, said passage having at its inner side two or more openings in communication with the interior of the bowl at approximately the level of the lower edge of the skirt, said lower edge of the skirt having an upwardly-concave recess concentric with said openings and a jet member fitted into each opening comprising a cylindrical head corresponding in axial length to substantially the distance from the inside surface of the rim to the inside surface of the skirt and of a radius such as to fit snugly into the recess in the skirt and a stem portion of yieldable material dimensioned to be forced to fit snugly into said openings and said stem portion having an axial passage of circular cross section extending from the outer end of said stem into the head and said head having a downwardly-open slot, the top of which is horizontally tangent to said passage at the top of the passage in the head portion, said slot cooperating with said passage and defining a surface opposite the outer end of said passage, the plane of which intersects the curved surface of the bowl above the water line.

2. A combination according to claim 1 wherein there is a shoulder at the junction of the stem with the head which has engagement with the inside surface of the rim and in combination with the yieldable stem fixes the head in place and wherein the inner end of the head has a flat end surface coinciding with the outside surface of the skirt.

* * * * *